US005261257A

United States Patent [19]

Collier

[11] Patent Number: 5,261,257

[45] Date of Patent: Nov. 16, 1993

[54] SEPARABLE KEYHOLDER WITH MULTIPLE KEYRINGS

[75] Inventor: Michael R. Collier, Denver, Colo.

[73] Assignee: Harmony Fastening Systems, Inc., Denver, Colo.

[21] Appl. No.: 828,242

[22] Filed: Jan. 30, 1992

[51] Int. Cl.[5] ..... A44B 15/00

[52] U.S. Cl. ..... 70/456 R; 24/575; 70/459

[58] Field of Search ..... 70/456 R, 456 B, 457, 70/458, 459; 206/37.1, 37.2-37.8, 38.1; 24/3 K, 575, 577, 579.1

[56] References Cited

U.S. PATENT DOCUMENTS

| | | |
|---|---|---|
| D. 92,798 | 7/1934 | Furtsch . |
| D. 222,408 | 10/1971 | Watson . |
| D. 235,385 | 6/1975 | Smyth . |
| D. 285,864 | 9/1986 | Sakai . |
| D. 299,480 | 1/1989 | Harari . |
| D. 308,294 | 6/1990 | Krasner . |
| D. 308,295 | 6/1990 | Sherlin . |
| D. 310,136 | 8/1990 | MacDonald . |
| D. 310,447 | 9/1990 | MacDonald . |
| D. 310,753 | 9/1990 | Stillwagon et al. . |
| D. 317,080 | 5/1991 | Stillwagon et al. . |
| 152,204 | 6/1874 | Wheatcroft . |
| 174,740 | 3/1876 | Read . |
| 230,495 | 7/1880 | Rae et al. . |
| 279,910 | 6/1883 | Candlish . |
| 293,831 | 2/1884 | Wickers . |
| 302,421 | 7/1884 | Mosier . |
| 364,312 | 6/1887 | Sipe . |
| 375,205 | 12/1887 | Sheldon . |
| 378,874 | 3/1888 | Davis . |
| 391,726 | 10/1888 | Voorhis . |
| 477,154 | 6/1892 | Quein . |
| 479,492 | 7/1892 | Davis . |
| 529,748 | 11/1894 | Picken . |
| 569,767 | 10/1896 | Quereau . |
| 669,931 | 3/1901 | Loudermilch . |
| 702,056 | 6/1902 | Hancock . |
| 749,321 | 1/1904 | Perkins . |
| 796,414 | 8/1905 | Chayes . |
| 807,150 | 12/1905 | Boice . |
| 870,617 | 11/1907 | Falter . |
| 879,282 | 2/1908 | Mandeville . |
| 932,806 | 8/1909 | Paulson . |
| 949,014 | 2/1910 | Aikins . |
| 983,093 | 1/1911 | Svenson et al. . |
| 1,009,533 | 11/1911 | Lacey . |
| 1,014,148 | 1/1912 | Heller . |
| 1,024,566 | 4/1912 | Gifford . |
| 1,047,376 | 12/1912 | Brynteson . |
| 1,061,805 | 5/1913 | Beach et al. . |
| 1,095,794 | 5/1914 | Braeklein . |

(List continued on next page.)

FOREIGN PATENT DOCUMENTS

| | | |
|---|---|---|
| 16433 | 6/1904 | Austria . |
| 48558 | 6/1911 | Austria . |

(List continued on next page.)

OTHER PUBLICATIONS

Advertisement: Miles Kimball, Oshkosh, Wisconsin Sep. 14, 1961.

*Primary Examiner*—Peter M. Cuomo
*Assistant Examiner*—Darnell M. Boucher
*Attorney, Agent, or Firm*—Kenton L. Freudenberg; Maxwell C. Freudenberg

[57] ABSTRACT

A key holder comprising two identically shaped parts each having a retainer for a plurality of apertured keys, the holder having at least one pair of mating latching structures holding the parts together when engaged and permitting the parts to be separated by only manually pulling the parts apart. Each latching structure includes a combination of a protuberance on one part and a cooperating protuberance-retaining recess on the other part. Each part has at least three distinct layers with first and second of the layers being thin flat and parallel and defining a space therebetween and a third layer offset with respect to the first and second layers. The third layer of each part lies parallel to and between the first and second layers of the other part with each third layer having a protuberance on one or both of its opposite faces, which protuberances are received in and retained by respective recesses in opposing faces of the first and second layers of the other part.

30 Claims, 5 Drawing Sheets

U.S. PATENT DOCUMENTS

| | | | |
|---|---|---|---|
| 1,126,610 | 1/1915 | Woolf | 24/575 |
| 1,185,913 | 6/1916 | Kittredge . | |
| 1,197,431 | 9/1916 | Barrett . | |
| 1,225,216 | 5/1917 | Boyer . | |
| 1,228,256 | 5/1917 | Stoll . | |
| 1,243,018 | 10/1917 | Wallace . | |
| 1,249,959 | 12/1917 | Hodges . | |
| 1,252,261 | 1/1918 | Goubert . | |
| 1,266,365 | 5/1918 | Whittaker . | |
| 1,368,316 | 2/1921 | Zobl . | |
| 1,450,199 | 4/1923 | Barber . | |
| 1,499,428 | 7/1924 | Wagner . | |
| 1,612,935 | 1/1927 | Mills et al. . | |
| 1,678,166 | 7/1928 | Repay . | |
| 1,701,970 | 2/1929 | Chaunard . | |
| 1,759,550 | 5/1930 | Friedlander . | |
| 1,823,229 | 9/1931 | Balbaud . | |
| 1,851,733 | 3/1932 | Shapiro . | |
| 1,909,654 | 5/1933 | Brown et al. . | |
| 2,114,429 | 4/1938 | Roseman . | |
| 2,165,928 | 7/1939 | Krischer . | |
| 2,347,263 | 4/1944 | Higgins et al. . | |
| 2,379,896 | 7/1945 | Fitzgerald . | |
| 2,392,659 | 1/1946 | Gore . | |
| 2,406,895 | 9/1946 | Olson . | |
| 2,447,422 | 8/1948 | Nelson . | |
| 2,478,433 | 8/1949 | Swanson . | |
| 2,478,434 | 8/1949 | Swanson . | |
| 2,503,570 | 4/1950 | Vogel . | |
| 2,523,488 | 9/1950 | Graham . | |
| 2,615,736 | 10/1952 | Bergan et al. . | |
| 2,628,855 | 2/1953 | Cushman . | |
| 2,738,477 | 3/1956 | Matthysse . | |
| 2,775,288 | 12/1956 | Anastasia . | |
| 2,840,878 | 7/1958 | Olson . | |
| 2,896,290 | 7/1959 | Salm et al. . | |
| 2,900,696 | 8/1959 | Bacon . | |
| 2,956,324 | 10/1960 | Klein . | |
| 3,000,069 | 9/1961 | Shears . | |
| 3,080,635 | 3/1963 | Gunther et al. . | |
| 3,111,736 | 11/1963 | Budreck | 70/457 |
| 3,120,971 | 2/1964 | Bengtsson . | |
| 3,167,835 | 2/1965 | Bengtsson . | |
| 3,192,747 | 7/1965 | Stupell et al. | 70/456 R |
| 3,196,878 | 7/1965 | Hedu . | |
| 3,200,464 | 8/1965 | Cousins . | |
| 3,251,110 | 5/1966 | Hedu . | |
| 3,327,362 | 6/1967 | Bosquet . | |
| 3,413,752 | 12/1968 | Perry | 24/575 |
| 3,430,306 | 3/1969 | Tareau . | |
| 3,520,033 | 7/1970 | Usuda | 24/575 |
| 3,530,546 | 9/1970 | Ferrando . | |
| 3,583,317 | 6/1971 | Gibson . | |
| 3,600,917 | 8/1971 | Krock . | |
| 3,657,775 | 4/1972 | Hancock . | |
| 3,695,074 | 10/1972 | Smyth et al. . | |
| 3,765,062 | 10/1973 | Cruse . | |
| 3,828,595 | 8/1974 | Williams, Jr. | 70/457 |
| 3,836,049 | 9/1974 | Smith . | |
| 3,837,049 | 9/1974 | Corrado . | |
| 3,844,000 | 10/1974 | Hedu . | |
| 3,979,801 | 9/1976 | Tareau . | |
| 3,979,934 | 9/1976 | Isenmann . | |
| 4,052,774 | 10/1977 | Noda . | |
| 4,150,464 | 4/1979 | Tracy . | |
| 4,161,806 | 7/1979 | Hennisse et al. . | |
| 4,204,300 | 5/1980 | Fildan . | |
| 4,363,159 | 12/1982 | Lischick . | |
| 4,398,324 | 8/1983 | Bakker et al. . | |
| 4,408,375 | 10/1983 | Skobel . | |
| 4,413,383 | 11/1983 | Spalding . | |
| 4,443,916 | 4/1984 | Tiemann . | |
| 4,443,917 | 4/1984 | Oddenino . | |
| 4,464,813 | 8/1984 | Bakker et al. . | |
| 4,474,043 | 10/1984 | Morrone . | |
| 4,488,336 | 12/1984 | Ambal . | |
| 4,489,466 | 12/1984 | Bakker . | |
| 4,502,191 | 3/1985 | Savage . | |
| 4,541,151 | 9/1985 | Herchenbach et al. . | |
| 4,559,679 | 12/1985 | Downey . | |
| 4,569,106 | 2/1986 | Lovato . | |
| 4,581,910 | 4/1986 | Brooks et al. | 24/575 |
| 4,616,953 | 10/1986 | Gomes . | |
| 4,621,393 | 11/1986 | Ambal . | |
| 4,633,549 | 1/1987 | Lovato . | |
| 4,662,040 | 5/1987 | Terrell et al. . | |
| 4,672,725 | 6/1987 | Kasai . | |
| 4,689,861 | 9/1987 | Kopelowicz . | |
| 4,712,280 | 12/1987 | Fildan . | |
| 4,726,705 | 2/1988 | Gomes . | |
| 4,774,744 | 10/1988 | Kasai . | |
| 4,776,191 | 10/1988 | MacDonald . | |
| 4,779,315 | 10/1988 | Kohus | 24/575 |
| 4,793,032 | 12/1988 | Crowle . | |
| 4,928,364 | 5/1990 | Ikeda . | |
| 4,982,480 | 1/1991 | Kasai . | |
| 4,999,885 | 3/1991 | Lee . | |
| 5,069,050 | 12/1991 | Chen | 70/456 R |
| 5,106,252 | 4/1992 | Shapton | 411/519 |

FOREIGN PATENT DOCUMENTS

| | | |
|---|---|---|
| 134081 | 2/1933 | Austria . |
| 29431 | 2/1922 | Denmark . |
| 5855 | 12/1979 | European Pat. Off. . |

(List continued on next page.)

FOREIGN PATENT DOCUMENTS

| | | | |
|---|---|---|---|
| 149102 | 7/1985 | European Pat. Off. . | |
| 0228656 | 7/1987 | European Pat. Off. . | |
| 222836 | 4/1909 | Fed. Rep. of Germany . | |
| 1435829 | 1/1969 | Fed. Rep. of Germany . | |
| 2062852 | 7/1972 | Fed. Rep. of Germany . | |
| 466126 | 5/1914 | France . | |
| 730372 | 8/1932 | France . | |
| 732885 | 9/1932 | France . | |
| 759167 | 1/1934 | France . | |
| 866047 | 6/1941 | France . | |
| 896043 | 2/1945 | France . | |
| 901042 | 7/1945 | France . | |
| 943056 | 2/1949 | France . | |
| 1026120 | 4/1953 | France . | |
| 1047398 | 12/1953 | France . | |
| 1067224 | 6/1954 | France . | |
| 1297872 | 5/1962 | France . | |
| 2135264 | 12/1972 | France . | |
| 2290860 | 6/1976 | France | 24/575 |
| 2452894 | 10/1980 | France . | |
| 56748 | 7/1967 | German Democratic Rep. . | |
| 411647 | 4/1945 | Italy . | |
| 460433 | 6/1951 | Italy . | |
| 39-11309 | 4/1961 | Japan . | |
| 43-4035 | 2/1968 | Japan . | |
| 55-2951 | 1/1980 | Japan . | |
| 56794 | 8/1944 | Netherlands . | |
| 18812 | 12/1907 | Norway . | |
| 112813 | 12/1944 | Sweden . | |
| 380423 | 9/1964 | Switzerland . | |
| 1644 | of 1891 | United Kingdom . | |
| 14765 | of 1892 | United Kingdom . | |
| 8157 | of 1896 | United Kingdom . | |
| 26631 | of 1897 | United Kingdom . | |
| 20007 | of 1899 | United Kingdom . | |
| 168861 | 7/1921 | United Kingdom . | |
| 779659 | 7/1957 | United Kingdom . | |
| 1138122 | 12/1968 | United Kingdom . | |
| 1332853 | 10/1973 | United Kingdom . | |
| 2035440 | 6/1980 | United Kingdom . | |
| 2093340 | 9/1982 | United Kingdom | 70/456 R |

Fig. 1
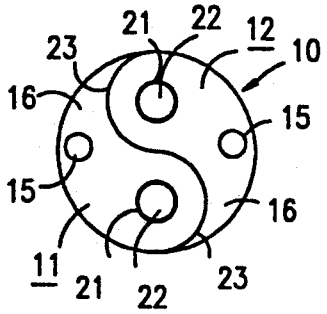
Fig. 2
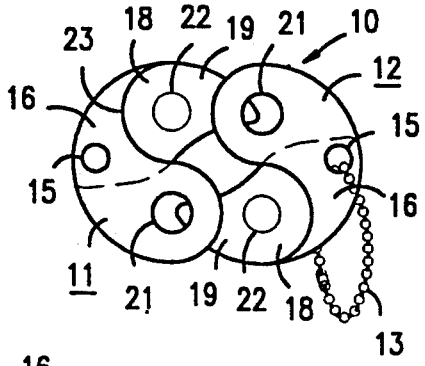
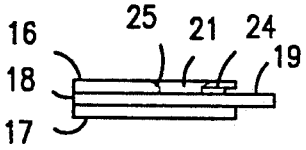
Fig. 3
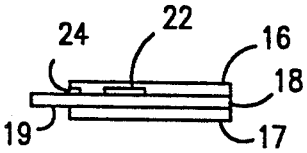
Fig. 4
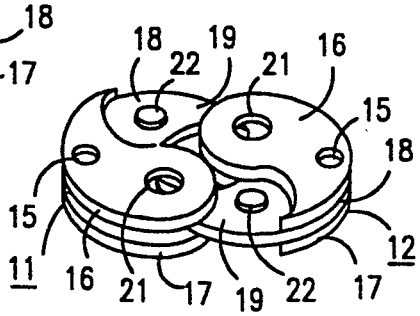
Fig. 5
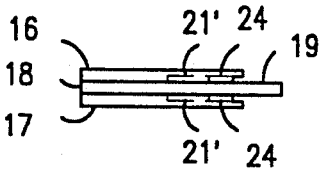
Fig. 7
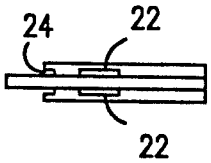
Fig. 8
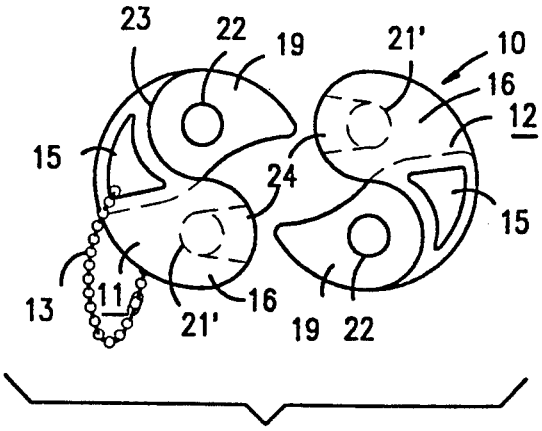
Fig. 6

Fig. 9
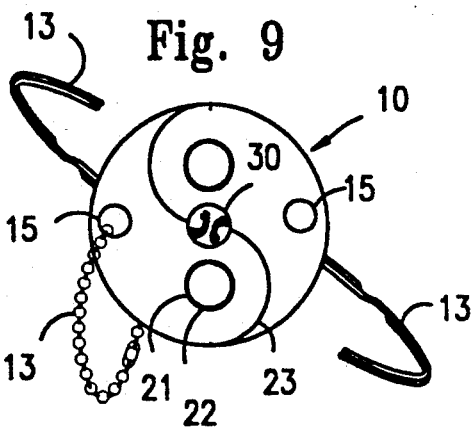
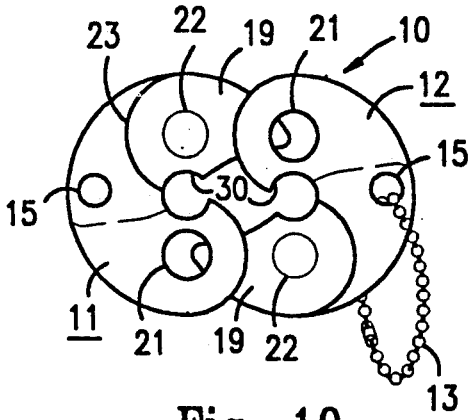
Fig. 10
Fig. 11
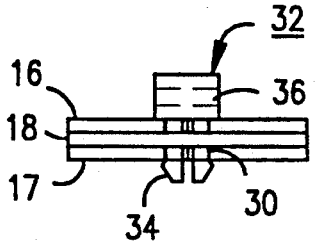
Fig. 12
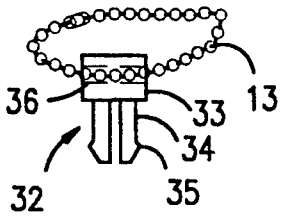
Fig. 15
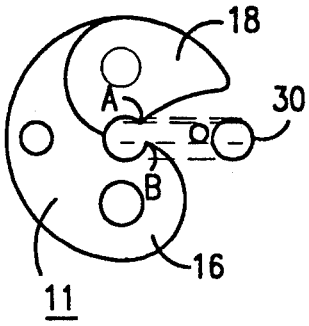
Fig. 13
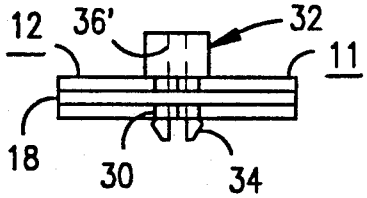
Fig. 14
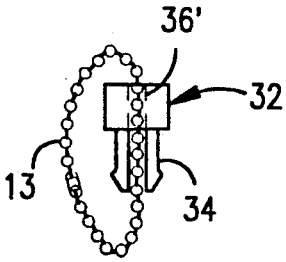
Fig. 16
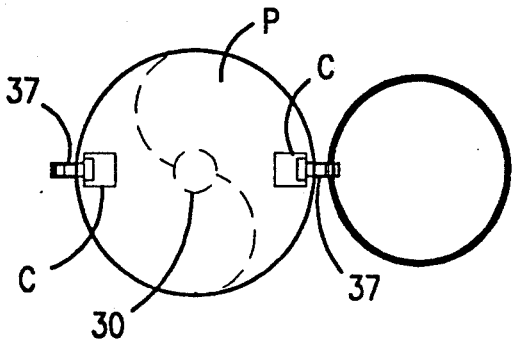
Fig. 17
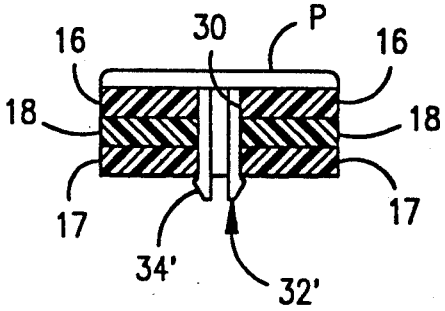

Fig. 18
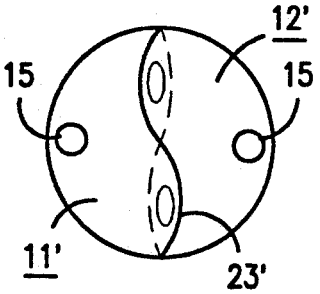
Fig. 19
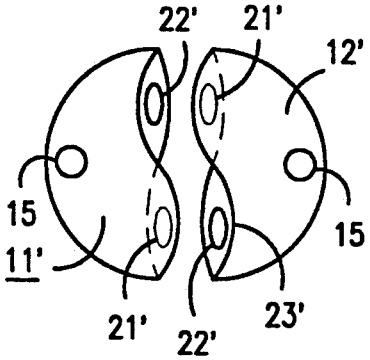
Fig. 19a
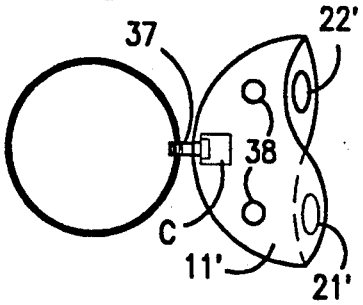
Fig. 18a
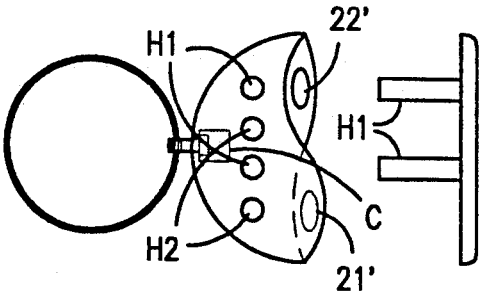
Fig. 21a
Fig. 20
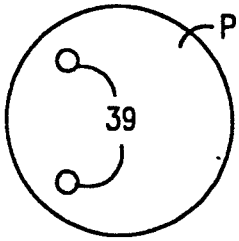
Fig. 21
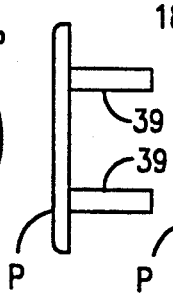
Fig. 22
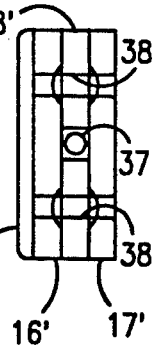
Fig. 23
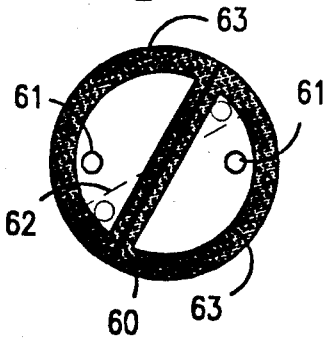
Fig. 24
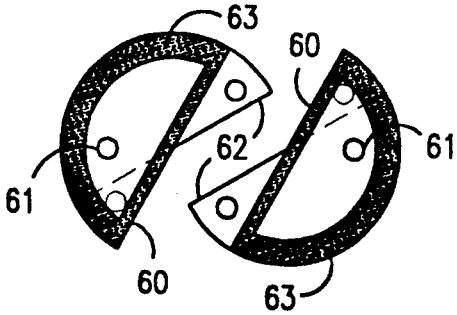
Fig. 25
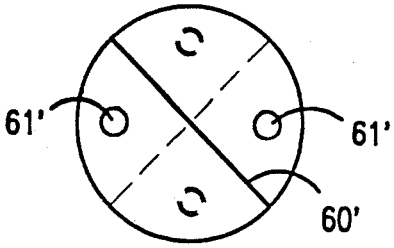
Fig. 26
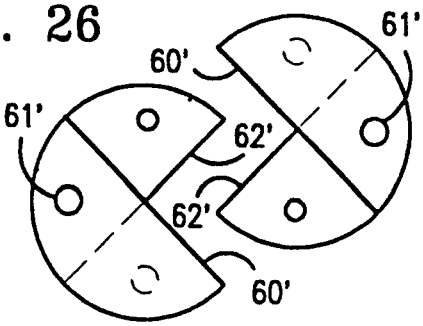

SEPARABLE KEYHOLDER WITH MULTIPLE KEYRINGS

The disclosure of this application contains material in common with co-pending application of the inventor hereof, Ser. No. 07/732,454, filed Jul. 18, 1991, which is a continuation-in-part of previous application, Ser. No. 07/257,728, filed Oct. 14, 1988, now abandoned.

BACKGROUND OF THE INVENTION

This invention relates to a key holder having two parts which may be latched together and which may releasably interconnect several key rings or key chain loops each holding a plurality of keys having holes through which the loops or rings extend.

Because of the diverse uses usually found for a multiplicity of conventional keys often carried by one person or used at one location such as an office or business site, it is often desirable to collect or carry such keys assembled in a group, but divided into subgroups which may be individually separated from the group for a variety of reasons, such as to temporarily separate into two or more groups keys for auto ignition, auto trunk, residential or business access, post office box or other common applications.

SUMMARY OF THE INVENTION

In accordance with this invention a key holder comprising two identically shaped parts is latched together by releasable latching means defined by portions of said identically shaped parts. The parts of the key holder are movable to and from their relatively latched positions of engagement merely by manually pushing and pulling the parts toward or away from each other along a particular direction. The pulling of each of said parts is typically achieved by grasping and pulling a key retainer for holding a plurality of apertured keys which is secured to the part. Each of the key holder parts comprises two layers in two parallel spaced strata and having opposed parallel faces defining a space between said layers, and a third layer in a stratum parallel to and between said two parallel strata. The third layer of each part has outer flat surfaces slidable on opposed parallel faces of the other part and in a predetermined direction between said two layers of the other part into said space when said parts are manually pushed together into latched engagement. The releasable latching means for holding the part together comprises at least two distinct relatively spaced pairs of cooperating interfering latching portions, one of the latching portions of each pair being on one of said surfaces of said third layer of one part and the other latching portion of that pair being located on a respective one of said parallel faces of a layer of the other of said parts. The parts of the key holder include resilient means for biasing the latching portions of each pair of cooperating interfering latching portions to their relative latching positions to hold said interfering latching portions against separation except when the parts are pulled apart by an intentional manual separating pull exterted on said key retainers along the aforementioned predetermined direction. The interfering latching portions which define each latching structure interact during the pushing of the parts into latched engagement, and during such an intentional manual separating pull, to displace at least one of the interfering portions of the latching structure against the bias of said resilient means to permit the parts to be respectively moved into latched engagement or completely separated.

The key holder body may be readily provided with locking means such as a separable locking plug which interferes with normal or conventional separation-pulling manipulation. The plug may be of such dimensions and so retained that in its absence a key ring may be retained in its place and permit the body parts to be manipulated by mere separation pulling to release the parts temporarily for detachment of the key ring.

The key holder body is so configured that one or both of the separable parts thereof may have a swiveling key-retaining pin secured thereto in a manner leaving large portions of the body surface unobstructed for the application thereto of artistic, informative or advertising indicia.

Among the objects of the invention is to utilize common moldable mutually interlocking parts as a basis for securing together a plurality of key rings or flexible key chain loops.

It is another object of this invention to achieve a low cost simple easily manipulated separable key holder structure having the capability of separably interconnecting two or more subgroups of keys which may be separated from each other while being retained in the respective subgroups and whereby such separated subgroups may be readily reassembled without risking loss of a key by having it separated from a key ring designated for its particular subgroup.

A further object of the invention is to provide a two-part separable structure for mutually securing together two or more key rings wherein the structure has plural surfaces which are useful for artistic decoration or advertising purposes by applying thereto two or three dimensional sculpture or indicia thereto.

Another object of the invention is to provide a basic simple subframe concept for a separable key holder body wherein exterior portions may be so varied in design or added thereto to enable making a variety of three dimensionally shaped configurations.

Still another object of the invention is to provide a basic simple subframe concept for a separable key holder body wherein an exterior identifying or advertising label may be readily secured to the body as well as being readily changed at the will of the user.

Another object of the invention is to provide a simple separable key holder buoy which, when separated, will buoyantly support separate key bearing rings attached to its parts.

Another object of the invention is to provide a relatively flat separable key holder body which lies as flat as possible when retained in a pants or other garment pocket or in a compartment of a purse or business case.

DESCRIPTION OF THE DRAWINGS

FIG. 1 is a plan view of a disk-shaped key holder of the preferred embodiment with two separable parts in their engaged positions FIG. 2 is a view similar to FIG. 1 but with the parts in partially separated positions and showing a chain ring in one of the parts, FIGS. 3 and 4 are side views of the separable parts of FIGS. 1 and 2.

FIG. 5 is a perspective view of the partially separated parts of FIG. 2.

FIGS. 6–8 illustrate a modified structure similar to FIGS. 1–5 but with different apertures for key rings as the only exposed apertures on opposite faces of the parts when engaged.

FIGS. 9–10 are views similar to FIGS. 1–2 of a modified embodiment having a central hole in each of the parts, FIG. 9 showing a pair of removable rings passing through the holes which are in registration.

FIGS. 11 and 13 are side views of engaged key holder parts of FIG. 9, but with different locking plugs inserted in the center registered holes.

FIGS. 12 and 14 illustrate the locking plugs of FIGS. 11 and 13 respectively, with a key chain ring passing through an aperture in each plug.

FIG. 15 is a plan view of one of the parts of FIG. 9 illustrating dimensional comparison of the center hole with a lateral opening or gap in the side of the hole.

FIGS. 16–17 are plan and side views of an embodiment in which the parts are shown engaged and with a cover plate secured thereto by a locking plug attached thereto and extending through a central hole, and with swiveled ring retaining pins extending from side walls of the parts at opposite sides of the key holder.

FIGS. 18–19 are plan views of another embodiment, symmetrical about an axis normal to the center of FIG. 18, and showing engaged and separated parts of a disk-like key holder in which latching structures occupy a smaller portion of the illustrated planar area of the holder. FIGS. 18*a* and 19*a* each represent half of a key holder of further modified embodiments with swivel type key ring retainers attached at the side peripheral walls of the holder and having one or more pairs of holes for receiving pins on cover plates like the plate of FIGS. 20 and 21.

FIGS. 20–22 are plan and side views illustrating attachment of an additional disk-like cover plate to a holder as in FIGS. 18–19, 18*a* and 19*a*.

FIGS. 23–24 are plan views of engaged and separated parts of another embodiment of a key holder, symmetrical about an axis normal to the center of FIG. 23, and in which the abutting edges of the respective layers in different strata are all straight and the illustrated face is in intaglio relief.

FIGS. 25–26 are plan views of engaged and separated parts of another embodiment of a key holder, symmetrical about an axis normal to the center of FIG. 25, and in which the abutting edges of the respective layers in different strata are all straight and diametrical, and the opposite faces of the key holder body are flat and parallel.

DESCRIPTION OF THE PREFERRED EMBODIMENT

Figure 27:
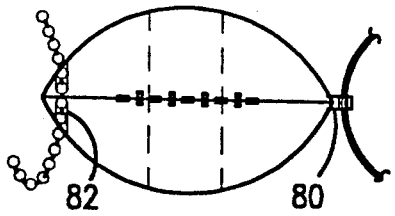
FIGS. 27–29 are top, end and side views of a five-layered key holder body in the shape of a miniature football and having two separable major structures.

In the embodiment of FIGS. 1–5 a key holder 10 comprises two identically-shaped mating parts 11 and 12 which may be engaged to define a relatively flat circular plate-like or disk-like key holder body having parallel flat outer faces and which parts are retained in their engaged positions by means of latching structures which allow the parts to be separated by merely pulling them apart manually. Each of the parts 11 and 12 will have attached thereto a conventional key retainer 13 for a plurality of apertured keys and in the form of a chain or a metal or plastic split key ring which is a flat circular ring having a two-turn helical configuration enabling the apertures of one or more keys to be threaded around the turns and onto the ring. Each ring is engaged within a suitable aperture 15 in a respective one of the key holder parts 11 or 12. Throughout the invention descriptions herein, reference to a split key ring or a beaded chain key ring are deemed to be equivalents unless otherwise specifically stated.

Each of the parts 11 and 12 has first and second outer flat parallel spaced layers 16 and 17 and a third layer 18 parallel to layers 16–17 and offset with respect thereto. Each of layers 16–18 is of essentially the same thickness and strata-wise the third layer is in a stratum between layers 16 and 17. The parts 11 and 12 may be oriented so that the layers 16 and 17 of one part 11 have parallel flat inner faces which form a female cavity into which the third layer 18 of the other part 12 may be inserted as a male member. Vise versa and simultaneously, the layers 16 and 17 of that other part 12 form a female cavity into which the third layer 18 of the one part 11 may be inserted as a male member. Each layer 18 has a web-like pointed extension or nose 19, tapering in thickness toward its tip, which tip is shown in FIG. 2, just slightly extending into the space between the members 16–17 of the other part to at least initially facilitate manually guiding the layer 18 into position between the respective layers 16–17. Upon further movement of the parts 11 and 12 toward each other the edges of the respective layers 16 and 17 of one part interact with corresponding respective layers of the other part to assist in guiding the parts precisely into engaged latched positions. The edges of layers 18 may also interact to assist in the guiding of the parts into their engaged position.

Figure 47:
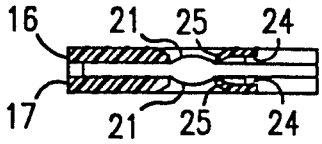
FIG. 47 is a section through the center of a pair of superposed protuberance-retaining holes in spaced strata and illustrating conical relief spaces outside the hole edges permitting outward deflection of the hole edges without interfering with surfaces which may overlie the outer ends of the holes.

At least one of the layers 16 and 17 of each part has a hole or recess 21 receding from its inner face for receiving and releasably retaining a cooperating raised or projecting button or protuberance 22 on, and raised slightly above, the respective parallel face or faces of the layer 18, such a cooperating recess and protuberance defining a latching structure by means of which the parts 11 and 12 are latched together. As indicated in FIGS. 3–4 and 6–8, these protuberances 22 are guided to the respective recesses 21 and 21' by guiding channels 24 on inner faces of respective outer layers 16 or 17. The layers 16 and 17 are resilient and may be sprung apart sufficiently by the insertion of a layer 18 with its protuberance(s) until each such protuberance snaps into a respective hole 21 whereupon the inwardly facing parallel surfaces of the parts 11 and 12 engage the opposite respective outwardly facing flat parallel surfaces of the intermediate layer 18. To make the edges of the holes 21 more easily flexed, the outer faces of a layer containing a hole 21 may be indented with a shallow conically recessed exterior surface 25 coaxial with the hole 21 as seen in FIG. 47 which shows a section through the center of a pair of superposed protuberance-retaining holes in spaced strata of one part and illustrates shallow conical relief spaces formed by the surfaces 25 at the outside of the hole edges permitting outward deflection of the hole edges without interference from other surfaces which may overlie the outer ends of protuberance-retaining holes 21 at the ends of the guiding channels 24.

In the embodiment of FIGS. 6-8 the recesses 21' which receive the protuberances 22 do not extend to the outer surfaces of the parts 11 and 12, leaving only the apertures 15 for key rings as the only exposed apertures on opposite faces of the engaged parts 11 and 12. The apertures 15 where the rings are secured to the parts 11 and 12 in FIGS. 1, 2 and 6 are at spaced points essentially along a line which is parallel to the direction in which a pulling force is exerted by the key rings when manually pulled to separate the key holder parts. When the parts 11 and 12 are engaged the opposite outer faces of the key holder have an S-shaped separation line 23 between layers 16—16 and a mirrored S-shaped separation line between the layers 17—17. The edges of the layers 16 and 17 which define these separation lines slide upon one another to help guide the parts 11 and 12 to their engaged positions. The parts 11 and 12 may be manually pressed together to their engaged positions by pressing on diametrically opposite points. The only manipulation of the parts 11 and 12 required for their separation is effected merely by pulling the rings 13 in apertures 15 in opposite directions to force the protuberances 22 outwardly under the retaining edges of the holes 21.

The embodiments of FIGS. 9-15 are similar to the embodiment of FIG. 1 except for the addition of a hole 30 of approximately the same diameter as holes 21 and located at the point of inflection of the S-shaped separation line 23. The hole 30 is essentially half in part 11 and half in part 12. Since a tangent to the separation line at the point of inflection is essentially perpendicular to a line connecting the centers of the holes 21 when the parts are engaged and parallel to the direction in which the rings 13 in apertures 15 would apply a pulling force for separation, separation of the parts may be prevented by locking means comprising a plug 32 inserted into the hole 30 to engage portions of the three layers 16-18 at the edges of hole 30 to block their relative separating movement. The axis of the holes 30 passes through the points of inflection of the S-shaped separation lines 23 and the plugs 32 are coaxial therewith.

The geometrical arrangement of the parts 11 and 12 at the hole 30 is more easily understood by referring to FIG. 10 where the parts are shown partially separated after the locking plug is removed and the edge of the hole 30 for each part is shown. Near the point where the edges of layers 16 and 18 converge and intersect the edge of the hole 30, the points of such intersections A and B are spaced a distance equal to about one half the diameter of hole 30 as seen in FIG. 15. Thus neither part 11 nor part 12 could be pulled off the side of the plug 32, the diameter of which is represented by the larger circle to the right of FIG. 15.

The locking plug 32 seen in FIGS. 11-14 has a shouldered portion 33 of greater diameter than the hole 30 and abutting the layers 16 at the sides of the hole 30. The locking portion of the plug within the hole is formed by means of a plurality of resilient fingers 34 extending axially from the shoulder 33 through hole 30 and having at their projecting tips transversely outwardly extending latching and camming portions 35 which assist the user in manually inserting or withdrawing the plug relative to the hole. When inserted, the portions 35 overlie the adjacent edge of the hole 30 to prevent inadvertent withdrawal of the plug 32. The resiliency of the fingers 34 is such that a reasonably strong manual pull on the plug is required for its removal. The shouldered end of the plug may have an aperture 36 extending transversely therethrough as seen in FIGS. 11-12 for reception of a key ring or chain loop. The key ring is an aid to applying a pull-out force to the plug as well as providing an additional ring for a key which might be removed from the key holder 10 and left with a parking attendant or the like.

A variation of the configuration of a locking plug 17 is shown in FIGS. 13-14 where an axial passage 36' is provided through the plug to accommodate a chain key ring looped from end to end through the plug and externally therearound. Sufficient clearance is provided between the inside surfaces of the fingers and the chain to permit the fingers to be deflected inwardly toward the chain to allow insertion or removal of the plug from the hole 30. In this case the chain ring remains in the hole 30 during insertion and removal of the plug. The diameter of the chain ring within the hole after the plug is withdrawn from the hole and along the chain ring is of such lesser size than the locking plug portion of this separable key ring that the parts 11 and 12 can then be removed from the chain which can escape from each hole through the space between the aforementioned intersection points A and B shown in FIG. 15 wherein the chain key ring diameter, which is smaller than the diameter of plug 32, is represented by the smaller circle to the right of FIG. 15. To assist in pulling the plug 32 from the hole, the shouldered portion may also be provided with a knurled or grooved peripheral gripping surface.

FIG. 16-17 are a plan and a simplified side section of an embodiment in which two parts similar to those of FIG. 10 are shown engaged and with a cover plate P secured to the end of a locking plug 32' attached thereto and extending through the central hole 30 to lock the keyholder parts in their latched positions. Swiveled key ring retaining pins 37 extend in opposite directions from small chambers C which retain the shoulders of the swivel pins in the sidewalls of the respective engaged parts at opposite sides of the key holder. FIG. 17 illustrates the arrangement of a plurality of resilient shouldered fingers 34' of the locking plug 32' which occupy hole 30 to hold the key holder parts against separation in the manner of FIGS. 10-15. In the embodiment of the invention illustrated in FIGS. 18-19 the two parts of the key holder define a circular plate-like body similar to FIG. 1, but in this embodiment the parts 11' and 12' are shaped so that the S-shaped separation line 23' is much flatter so that a tangent to this curve at its point of inflection at the center of the key holder body is at an acute angle of approximately 45 degrees with respect to a line interconnecting the cooperating latching protuberances and recesses on each body part. The retaining recesses 21' and protuberances 22' are also elongated in the direction generally parallel to the separation line 23' and transversely with respect to the direction of relative separation of the parts effected by pulling on key rings secured to the key holder parts. Each body part comprises three layers similar to the layers 16–18 of the earlier described FIGS. 1–4, but the means for attaching a key ring to each of the two body parts may be different, as seen in FIGS. 18*a* and 19*a*, each showing one of two identical mating parts of the key holder. Here the middle one 18' of the three layers is provided with a small rectangular chamber C near the center of its arcuate outer wall portion with a notch or hole through this outer wall portion. A rotatable shouldered pin member 37, having its shoulder abutting the inner wall of the chamber C, extends outwardly through the notch or hole and has secured to its outer end, outside the key holder body, a suitable key ring. The top and bottom of the chamber C may be covered by portions of the two outer layers 16' and 17'.

A further variation of the key holder body is provided in FIGS. 20–22 where a circular cover plate P essentially diametrically coextensive with the plate-like body 10 formed by the engaged pair of three-layer body parts. To keep the structure of each of the two key holder body parts identical, one outer cover plate is secured to each part. As seen in FIGS. 21–22, each plate is secured to its respective body part by means of a pair of pins 39 which extend perpendicularly with respect to the plate P and penetrate into and are suitably secured in holes 38 in one or more of the layers 16'–18' to secure (preferably irremovably if part of an advertising indicia) the plate P thereto. The holes 38 are so located that pins located therein do not interfere with intended relative movement of the interleaved layers or strata of the key holder parts during their engagement or separation. If such cover plate is made readily removable as by a mere friction fit of the pins 39 in their respective holes, the plate may be changed from time to time at the will of the user to provide different identification of the user or grouping of the keys attached thereto.

The three principal layers of each body part may be molded together as an integral unit with the holes 38 molded therein and the cover plate P added thereafter. This enables a large number of such units to be made for common components of key holders having different artistic works or advertising logos on, and different material colors for, the cover plates which can be easily selected or changed as needed. If the three layers are molded together, the chamber C may be formed therein as shown in FIGS. 16, 18*a*, 19*a* 29 and 38 to provide means for attaching or inserting the shouldered pin member 37.

If two offset pairs of holes 111 and 112 are provided in each part of the key holder and the two pins 39 on the cover plate correspondingly offset, as shown in FIG. 18*a*, identical cover plates can be attached to separate parts 11 and 12 or two plates can be secured to respective opposite faces of one key holder part. In such case, the other key holder part is then merely slid between the two cover plates for engagement of the parts.

An example of a key holder in accordance with this invention and having outer surfaces embodying a design or indicia in intaglio or depressed type relief is shown in FIGS. 23–24. Here the indicia represents the well-known international prohibitory or "NO" background such as is seen in signs for traffic regulation. The separation line 60 along and between the abutting edges of the outer layers of the parts, on the principal illustrated face of the body as well as at the rear face, is straight or linear and at an angle of approximately 45 degrees from lower left to upper right with respect to an imaginary horizontal line connecting the two holes 61 provided for the addition of key rings to the two body parts. The separation line 62 along and between the abutting edges of the center layers of the key holder parts is also straight or linear and is at an angle of about 22.5 degrees relative to line 60 as seen in FIGS. 23–24. The latching structures of this embodiment are located along a line midway between lines 60 and 62 in the acute angle defined by these lines. The two D-shaped peripheral raised portions 63 together form the "NO" indicia and the recessed central portions of these D-shapes may be provided with any suitable correlated indicia as well as providing loci for the holes 61.

FIGS. 25–26 depict another embodiment in which the opposite outer faces of a disk-like key holder body are flat parallel surfaces and in which the separation line 60' along and between the abutting edges of the outer layers of the parts, on the principal illustrated face of the body as well as at the rear face, is straight or linear and at an angle of approximately 45 degrees from lower right to upper left with respect to an imaginary horizontal line connecting the two holes 61' provided for the addition of key rings to the two body parts. The separation line 62' along and between the abutting edges of the center layers of the key holder parts is also straight or linear and is perpendicular to line 60' as seen in FIGS. 25–26. The latching structures of this embodiment are located along a line midway between lines 60' and 62' and perpendicular to the line connecting the holes 61'. For FIGS. 23–26 the latching means comprising the cooperating pairs of interfering protuberances and protuberance-retaining recesses function like those of FIGS. 1–2 and 18–19.

Figure 28:
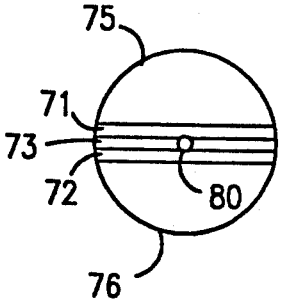
Figure 29:
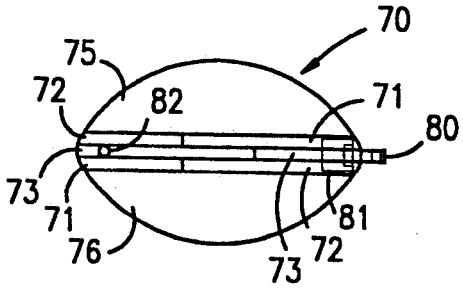
Figure 30:
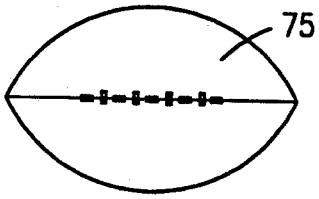
FIGS. 30–34 are, respectively, separate views illustrating the structure of the portions of the body in the five layers as seen progressing from the top layer to the bottom layer of FIGS. 28 and 29.
Figure 31:
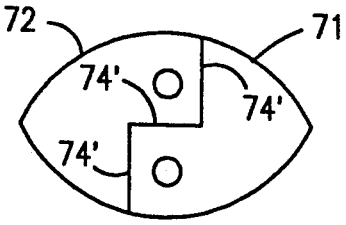
Figure 32:
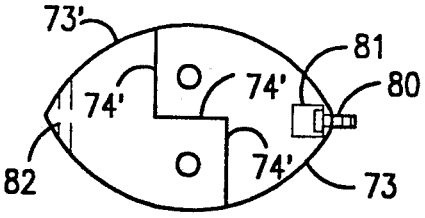
Figure 33:
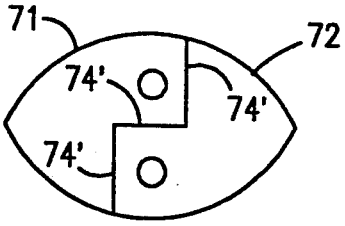
Figure 34:
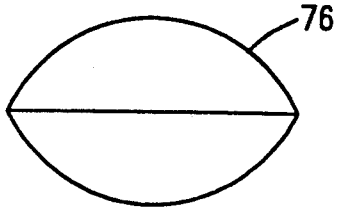

An example of a key holder in accordance with this invention and having outer surfaces embodying a design or indicia in cameo or raised type relief is shown in FIGS. 27–29. Here the body 70 of the key holder design represents a football having much greater three-dimensional (3-D) depth than the previously described plate-like embodiments. To facilitate depiction of the layers of the football body 70, the respective flat parallel layers 71, 72 and 73, corresponding to layers 16, 17 and 18, respectively, of the first described embodiment, are drawn in separate views. The separation lines are zigzag lines as seen at 74 where separation line portions 74' extend transversely with respect to the football' longitudinal axis, whereas the separation line portion 74'' extends parallel to this axis. The cover layers 75 and 76 providing most of the external 3-D surface area of the football shaped key holder body may be secured to the respective body parts in any suitable manner.

The key rings for the football body 70 may be attached as shown at one end by a shouldered swiveling pin 80 projecting from an internal chamber 81 in the tip of the football body 70 in a manner similar to that described in connection with FIGS. 18*a* and 19*a*. Alternatively the key ring may be attached by passing a key ring through a suitable aperture 82 drilled across the body through layer 73.

In all of the embodiments thus far described, there are three principal flat, parallel, stacked layers, in identically shaped body parts, wherein the central layers form male members pointing in opposite directions and wherein the layers have cooperating and mating protuberances and recesses defining essentially one or more side-by-side pairs of latching or retaining structures. However it is also within the spirit of this invention to arrange such flat, parallel, stacked layers of identically shaped parts so that the pairs of mating protuberances and recesses define pairs of latching or retaining structures arranged end-to-end.

Figure 35:
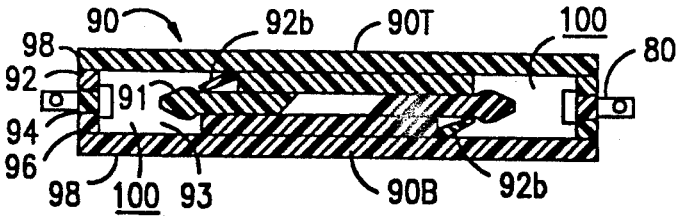
FIG. 35 is a section along a central lengthwise vertical plane of an elongated five-layered key holder body having two principal engaged separable parts forming the shape of a parallelpiped block. The block has an essentially square transverse section throughout and has, on the two separable parts of the key holder body, collinearly oriented male members which move along a central stratum to and from latched positions in respective female structures in the respective opposite parts.
Figure 36:
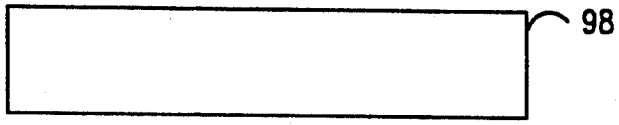
FIGS. 36–40 are, respectively, separate views illustrating the structure of the parts of the body in the five layers as seen progressing from the top layer to the bottom layer of FIG. 35.
Figure 37:
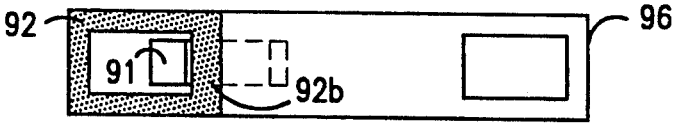
Figure 38:
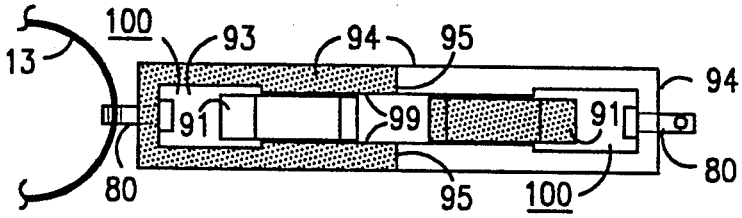
Figure 39:
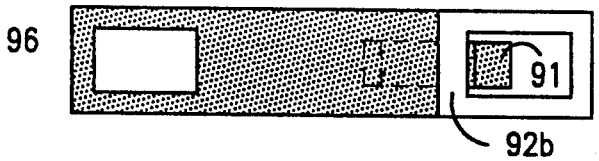
Figure 40:
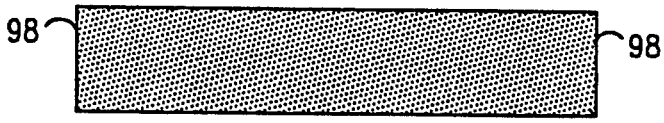

FIGS. 35–40 illustrate an elongated rectangular parallelpiped block 90 defined by two identical mating key holder parts 90B (bottom) and 90T (top) relatively moveable endwise to or from latching engagement with each other. The bottom key holder part 90B in which the left swiveled key ring is secured comprises four flat parallel members each extending from the left end of block 90 and forming four lowermost stacked layers or strata of the five layer block 90. The four layers of part 90B from top to bottom as seen in FIG. 35 are: (1) a flat short rectangular layer member 92 with a central rectangular opening 93; (2) and intermediate length U-shaped layer member 94 having legs 95 extending half the length of the block 90; (3) a longer rectangular layer member 96 of a length equal to the length of the block 90 minus the length of the short rectangular member 92; and, (4) a rectangular cover plate layer 98 extending over the entire bottom face of the block 90. The top key holder part 90T comprises from bottom to top four identical layers 92, 94, 96 and 98, each extending from the right end of the block 90, with the layers 92, 94 and 96 of part 90T being in the same respective strata as layers 96, 94 and 92 of part 90B.

Each part has a pair of parallel flat spaced layers or strata 92 and 96 defining the top and bottom of a female recess in a first end of the part near an end of the block and a central layer or strata 94 therebetween in which is located, in the other end of the part, a flat nose-like member 91 parallel to the spaced parallel layers 92 and 96 and pointing away from the first end of the part and toward the other end of the block 90.

The flat nose-like member 91 for part 90B is centrally secured atop the right end of layer member 96 and projects beyond the end of member 96 toward the right end of block 90. The identically shaped and essentially collinear nose-like member 91 for part 90T is similarly secured to the underside of the left end of layer member 96 of part 90T. Each of the layer members 94 and 96 has an open rectangular area, 93' and 93'', respectively in registry with the rectangular opening 93 of layer member to define a chamber 100 in the end of the respective part for receiving the portion of the opposing male member 91 to be latched therein. The inner side faces 99 of the legs 95 of the U-shaped layer 94 of each part cooperate with the layers 92 and 96 of the respective part to not only define all four sides of the female recess which receives the male member 91 of the other part, but also to form a channel to guide that male member 91 into the female recess. The upper and lower surfaces of the members 91 have raised protuberances 101 which pass under a resilient bridge portion **92*b* of the short layer member 92 and deflect this bridge member upwardly sufficiently for such passage. After passing beyond the bridge 92*b* and when the parts are fully engaged, the resiliency of the bridge and of the member 91 causes the bridge to snap behind one of the nose's protuberances and forces the other protuberance on the resiliently deflectable member 91 to drop below and be retained by an edge portion of the rectangular opening in the layer member 96**.

The chambers 100 also provide a means for placing shouldered swiveled key ring retaining pins from the inside outwardly through holes in the outer wall portion of layer member 96 for attachment of a swiveled key ring to one end of each key holder part 90B and 90T.

In the embodiments of FIGS. 27–40, the football-like and block configurations may have sufficient volume of low density plastic portions in each of the two separable parts so that each of the two key holder parts will have sufficient buoyancy to keep afloat in a body of water the respective key ring thereon. In any of the embodiments where a key ring retainer is inserted into a hole in the external wall of a key holder part, i.e. FIGS. 16, **18*a*, 19*a*, 27 and 38, a plug-like structure similar to that of FIGS. 11–12**, but of smaller diameter and with snap in non-removable shoulders on the fingers and perpendicular to its axis could be used.

In each of the three embodiments of FIGS. 41–46, there is illustrated only one mating part of a flat key holder body which is made up of two identical such engaged mating parts to define the general shape of the numeral "8". Each part of the body has a first end comprising two flat annular resilient members 116 and 117 in parallel spaced strata and a second end forming a single flat stratum or web portion member 118. Each annular member 116 and 117 of one such engaged part has a central retaining recess 121 for closely encircling and retaining a respective protuberance 122 on the adjacent face of the web or stratum 118 of the other engaged part to form a latching structure to aid in holding the engaged parts together.

The protuberances engage the inner opposed outwardly diverging faces of the annular members as the protuberances are pushed toward the holes 121 and spring the resilient annular members apart until the edges of the hole snap into position over the respective protuberances to retain the latter to securely fasten the parts of the key holder together. The edges of the holes and of the protuberances permit the parts to be separated from their engaged positions by exerting only a predetermined manual pulling force in opposite directions on key rings in the holes 115 of the two mated parts.

Figure 43:
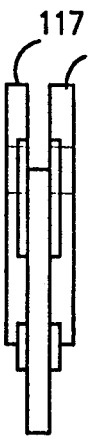
Figure 44:
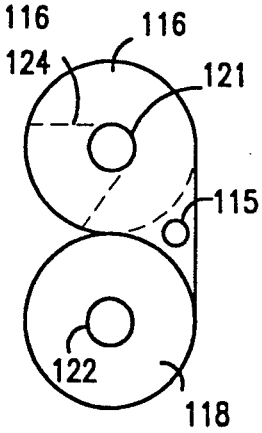

In FIGS. 43–44 the generally triangular portion of each part having the ring receiving hole 115 therethrough has a thickness equal to the thickness of the three strata of the members 116, 117 and 118. This triangular portion has surfaces 125 which form extensions of layers 116 and 117 to provide S-shaped edge configurations of these layers above and below the web or stratum 118 which abut and complement the complementary peripheral shape of the extended annular members 116 and 117 to the other part when the parts are engaged. Similarly this triangular portion has a surface 127 in the stratum 118 between the two annular members 116 and 117 which abuts and complements the same peripheral shape 127 of the web portion 118 of the other part when the parts are engaged. These complementary surfaces aid in guiding the parts and latching structures together when they are manually pushed together.

Figure 41:
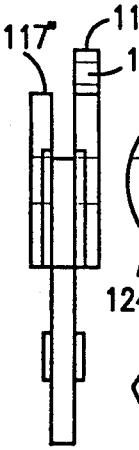
FIGS. 41–42, 43–44 and 45–46 are sets of front and side views of three different key holder body components each of which can be mated with an identical twin component to define a body having two engaged and relatively latched parts with the general appearance of the FIG. "8".
Figure 42:
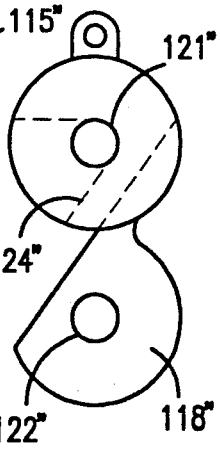
Figure 45:
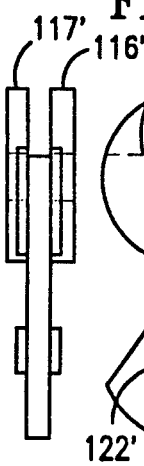
Figure 46:
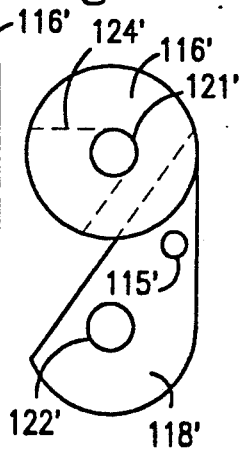

In the embodiments using two engaged parts like the one shown in FIGS. 41–42, or two parts like the one shown in FIGS. 45–46, the parts are guided together by engagement of the peripheral edge surfaces 126', 126' of the annular members of one part with corresponding surfaces 126, 126 of the annular members of the other part to be engaged and by engagement of web edge surfaces 127'', 127' of the respective webs of the parts to be engaged.

Although the preferred method of securing together multiple layers or strata of each individual separable component of the key holder is to mold the parts together, the layers may be united by heat fusion, high frequency heating, sonic fusion, adhesion or physically clamping according to well known processes for use with plastic materials. Pins as shown and described in connection with FIGS. 20–22 may be similarly used, either by themselves or initially attached to one or more of the layers, to secure together various strata or layers in other embodiments.

Other variations within the scope of this invention will be apparent from the described embodiment and it is intended that the present descriptions be illustrative of the inventive features encompassed by the appended claims.

What is claimed is:

1. A key holder comprising two identically shaped parts each having secured thereto a retainer for a plurality of apertured keys, said retainers being secured to said parts at points at opposite ends of said holder when the parts are engaged, the holder having at least one pair of mating latching structures holding the parts together when engaged and permitting the parts to be separated by only manually pulling said points away from each other in opposite directions to force the latching structures apart, each latching structure including a combination of a protuberance on one part and a cooperating protuberance-retaining recess on the other part, each part having at least three distinct layers with first and second of the layers being thin flat and parallel and having opposed faces defining a space therebetween and a third layer in a stratum parallel to and between said first and second layers and offset in said stratum with respect to the first and second layers, the third layer of each part lying parallel to and between the first and second layers of the other part and having opposite faces within said space exposed to and in contact with the opposed respective faces of those first and second layers of the other part when the parts are engaged, each third layer having one said protuberance on at least one of said exposed faces, each such protuberance being received in latched engagement with and retained by a respective protuberance-retainin recess in one said opposing face of a layer of the other part when said parts are engaged.

2. A key holder according to claim 1 wherein said latching structures of said pair are disposed on opposite sides of a line generally extending between said key retaining members.

3. A key holder according to claim 1 wherein each of said key retaining members is a key ring.

4. A key holder comprising two similarly shaped parts each having secured thereto a retainer for a plurality of apertured keys, the holder having at least one pair of mating latching structures holding the parts together when engaged and permitting the parts to be separated by only manually pulling the parts apart, each latching structure including a combination of a protuberance on one part and a cooperating protuberance-retaining recess on the other part, each part having at least three distinct layers with first and second of the layers being thin flat and parallel and defining a space therebetween and a third layer in a stratum parallel to and between said first and second layers and offset in said stratum with respect to the first and second layers, the third layer of each part lying parallel to and between the first and second layers of the other part and having opposite faces exposed, respectively, to opposed faces of those first and second layers of the other part when the parts are engaged, each third layer having one said protuberance on at least one of its exposed faces, which protuberances are received in and retained by respective protuberance-retaining recesses in opposing faces of the layers of the other part when said parts are engaged, said key holder further comprising a hole through each of said parts, said holes being concentric with a common axis extending perpendicularly to said parallel structures when the parts are engaged whereby a removable locking plug can be placed manually in said holes to prevent said pulling separation of said parts until said plug is manually removed from said hole.

5. A key holder according to claim 4 wherein the periphery of said hole is only partially defined in each said part by edges of said two parallel layers and the edge of said third layer, the hole in each said part having a laterally open peripheral opening having an angular extent substantially less than 180 degrees around said axis the transverse dimensions of the hole inside of the opening in each part being greater than the transverse dimensions of the opening.

6. A key holder according to claim 5 wherein a plug of transverse dimensions greater than said opening is inserted in said holes to lock said parts in engagement and prevent their separation until said plug is manually removed.

7. A key holder according to claim 5 including a key ring having a portion extending through the holes in both said parts with the parts in engagement, said key ring portion having transverse dimensions smaller than the width of said the peripheral openings of the holes in each part, to permit said parts to be separated and allow the key ring to be separated from each part by passing through the peripheral openings of said holes.

8. A key holder according to claim 4 including a plug in said holes and having an additional key retainer attached thereto.

9. A key holder according to claim 4 wherein a separable key ring includes a portion of one size which can be inserted into the holes of said parts to prevent their separation and a portion of a lesser size which can be moved to within the holes to allow separation of the parts from each other and from the separable key ring.

10. A key holder according to claim 4 wherein two separate key rings each extend through said holes in said parts and each can be separately removed from said key holder by temporarily manually separating said parts.

11. A key holder according to claim 1 including a cover member secured to one of said parts and extending over one side of the key holder generally parallel to said parallel layers, said cover member overlying essentially the entire key holder at said one side.

12. A key holder according to claim 1 wherein each part includes a cover portion, the cover portions and outer exposed peripheries of said layers defining a three dimensional shell concealing the latching portions of said parts.

13. A key holder according to claim 12 wherein the cover portions provide flat parallel outer surfaces suitable for advertising or artistic indicia thereon.

14. A key holder according to claim 12 including means for securing said cover as an initially separate structure to the layers of a respective key holder part.

15. A key holder according to claim 14 wherein the means for securing said cover to said part comprises pin means extending from said cover into said part.

16. A key holder according to claim 1 wherein there are multiple pairs of latching structures defining two distinct separate latching points, the pull required to separate said parts being that required to simultaneously overcome the combined retaining forces at all said latching points.

17. A key holder according to claim 1 wherein there are multiple pairs of latching structures defining four distinct separate latching points, the pull required to separate said parts being that required to simultaneously overcome the combined retaining forces at all said latching points.

18. A key holder according to claim 1 wherein said layers of the respective parts in one stratum abut each other along a line of separation extending generally transversely of a line extending between said key retaining members.

19. A key holder according to claim 18 wherein said line of separation is S shaped.

20. A key holder according to claim 4 wherein said first and second layers abut in their respective strata along an S-shaped line of separation extending generally transversely of a line extending between said key retainers and wherein the axis of said holes coincides with the inflection points of said S-shaped lines of separation.

21. A key holder according to claim 18 wherein said line of separation is a straight line.

22. A key holder according to claim 18 wherein said line of separation between the two layers of the respective parts limits the respective relative transverse movement of the parts in one direction during movement of the parts into engagement and the line of separation between the third layers of the respective parts limits the relative transverse movment in the opposite direction whereby the parts are guided directly to the relative positions where cooperating latching portions of each latching structure engage one another.

23. A key holder comprising two parts latched together by releasable latching means defined by portions of said parts, said parts being movable to and from their relatively latched positions of engagement by manually pushing and pulling the parts toward or away from each other along a particular direction, each of said parts having secured thereto a key retainer for holding a plurality of apertured keys, said key retainers being secured to said parts at respective points spaced from each other essentially along a line parallel to said direction, each of said parts comprising two layers in two parallel spaced strata and having a space between said layers, each of said parts also having a third layer in a stratum parallel to and between said two parallel strata, said third layer of each part being slidable in said direction between and in engagement with said two layers of the other part and into said space when said parts are manually pushed together into latched engagement, said latching means comprising at least two distinct relatively spaced pairs of cooperating interfering latching portions, one of the latching portions of each pair being on one of said two layers of one of said parts and the other latching portion of that pair being on the third layer of the other of said parts, said latching means including resilient means for biasing the latching portions of each pair of cooperating interfering latching portions to their relative latching positions to hold said interfering latching portions against separation except when the parts are pulled apart by an intentional manual separating pull exerted on said key retainers along said direction, said interfering latching portions of each such pair interacting during the pushing of the parts into latched engagement, and during such an intentional manual separating pull, to displace at least one of said interfering portions of such pair against the bias of said resilient means to permit the parts to be respectively moved into latched engagement or to release the latching means in response to such a manual separating pull on said key retainers whereby the key holder parts can be completely separated by such a pull.

24. A key holder according to claim 23 with a wall portion of at least one of the parts having an aperture therein extending generally parallel to said parallel strata and parallel to said direction of pulling separation, a swiveling member secured in each said aperture and having an extension at the outside of the respective part, and a key retainer secured to each said extension.

25. A key holder according to claim 24 wherein said aperture extends from a chamber within the respective part to the exterior of the key holder, said swiveling member being insertable through said aperture from the interior of said chamber.

26. A key holder according to claim 24 wherein said swiveling member is insertable into said aperture from the exterior of said wall portion and is self retaining in said aperture.

27. A key holder according to claim 23 wherein said two layers at least partially define a female recess, and each third layer includes a male member, the male members of said parts extending essentially collinearly during movement of each male member of one part in the respective female recess of the other part when the parts are moved to and from engagement along said direction.

28. A key holder according to claim 23 wherein the density of said parts is such that each part will buoyantly support its respective key retainer with several keys thereon in a body of water.

29. A key holder according to claim 23 wherein the density of said key holder is such that it will buoyantly support at least one key retainer secured thereto with several keys thereon in a body of water.

30. A key holder comprising two identically shaped parts latched together by releasable latching means defined by portions of said identically shaped parts, said parts being movable to and from their relatively latched positions of engagement by manually pushing and pulling the parts toward or away from each other along a particular direction, each of said parts having secured thereto a key retainer for holding a plurality of apertured keys, each of said parts comprising two layers in two parallel spaced strata and having opposed parallel faces defining a space between said layers, each of said parts also having a third layer in a stratum parallel to and between said two parallel strata, said third layer of each part having outer flat surfaces slidable on said opposed parallel faces of the other part in said direction between said two layers of the other part into said space when said parts are manually pushed together into latched engagement, said latching means comprising at least two distinct relatively spaced pairs of cooperating interfering latching portions, one of the latching portions of each pair being on one of said surfaces of said third layer of one part and the other latching portion of that pair being located on a respective one of said parallel faces of a layer of the other of said parts, said parts including resilient means for biasing the latching portions of each pair of cooperating interfering latching portions to their relative latching positions to hold said interfering latching portions against separation except when the parts are pulled apart by an intentional manual separating pull exerted on said key retainers along said direction, said interfering latching portions of each such pair interacting during the pushing of the parts into latched engagement, and during such an intentional manual separating pull, to displace at least one of said interfering portions of such pair against the bias of said resilient means to permit the parts to be respectively moved into latched engagement or completely separated.

* * * * *